US009688289B2

(12) United States Patent
Luger et al.

(10) Patent No.: US 9,688,289 B2
(45) Date of Patent: Jun. 27, 2017

(54) SYSTEM FOR TRANSPORTING PEOPLE

(71) Applicant: INNOVA PATENT GMBH, Wolfurt (AT)

(72) Inventors: Peter Luger, Dornbirn (AT); Johannes Moritzhuber, Hard (AT); Gerd Duer, Bildstein (AT)

(73) Assignee: Innova Patent GmbH, Wolfurt (AT)

( * ) Notice: Subject to any disclaimer, the term of this patent is extended or adjusted under 35 U.S.C. 154(b) by 78 days.

(21) Appl. No.: 14/763,569

(22) PCT Filed: Oct. 16, 2014

(86) PCT No.: PCT/AT2014/000185

§ 371 (c)(1),
(2) Date: Jul. 27, 2015

(87) PCT Pub. No.: WO2015/077806

PCT Pub. Date: Jun. 4, 2015

(65) Prior Publication Data

US 2016/0016593 A1 Jan. 21, 2016

(30) Foreign Application Priority Data

Nov. 28, 2013 (AT) ..... A 912/2013

(51) Int. Cl.
*B61B 15/00* (2006.01)
*B61B 3/02* (2006.01)
(Continued)

(52) U.S. Cl.
CPC ..... *B61B 15/00* (2013.01); *B61B 3/02* (2013.01); *B61B 7/02* (2013.01); *B61B 12/00* (2013.01)

(58) Field of Classification Search
CPC .... B61B 7/00; B61B 7/02; B61B 7/04; B61B 7/06; B61B 3/02
See application file for complete search history.

(56) References Cited

U.S. PATENT DOCUMENTS 4,669,389 A * 6/1987 Tarassoff ..... B61B 7/04 104/173.2
4,802,416 A * 2/1989 Meinl ..... B61B 12/10 104/173.1
(Continued)

FOREIGN PATENT DOCUMENTS

DE 846854 C 8/1952
DE 102010034465 A1 2/2012
(Continued)

*Primary Examiner* — Jason C Smith
(74) *Attorney, Agent, or Firm* — Laurence A. Greenberg; Werner H. Stemer; Ralph E. Locher

(57) ABSTRACT

A transport system has at least one hauling cable to which a cableway vehicle formed with running gear and a vehicle cab can be coupled. Alternatively, the system has a carrying cable or a track on which a cableway vehicle formed with running gear and a cab can be moved by a traction cable. The section with the hauling cable or carrying cable, or the track, is adjoined by a further track section along which a carrying vehicle for the cableway vehicle can be moved. The carrying vehicle has a drive motor. The running gear of the cableway vehicle runs onto and attaches to the carrying vehicle, whereupon the cableway vehicle is movable along the adjoining track by the carrying vehicle.

16 Claims, 10 Drawing Sheets

(51) Int. Cl.
*B61B 7/02* (2006.01)
*B61B 12/00* (2006.01)

(56) References Cited

U.S. PATENT DOCUMENTS 5,069,140 A 12/1991 Glassey
5,172,640 A * 12/1992 Cathiard ..... B61B 7/04 104/173.2
5,465,668 A * 11/1995 Tarassoff ..... B61B 7/02 104/112
5,562,040 A * 10/1996 Egli ..... B61B 7/045 104/173.1
5,575,215 A * 11/1996 Egli ..... B61B 7/045 104/173.1
5,873,310 A * 2/1999 Creissels ..... B61B 12/022 104/173.2
8,156,873 B1 * 4/2012 Olson ..... B61B 3/02 104/89
8,849,482 B2 9/2014 Sonnerer et al.
9,168,931 B1 * 10/2015 Olson ..... B61B 3/02
9,487,219 B2 * 11/2016 Sonnerer ..... B61B 7/02
2005/0081738 A1 * 4/2005 Meindl ..... B61B 7/02 104/173.1
2006/0163880 A1 * 7/2006 Wobben ..... F03D 1/003 290/44
2008/0152467 A1 * 6/2008 Moritzhuber ..... B61B 12/022 414/271
2008/0202375 A1 * 8/2008 Quattlebaum ..... A63G 21/22 104/112
2009/0044718 A1 * 2/2009 Spengler ..... B66C 21/02 104/112
2011/0083577 A1 * 4/2011 Tilley ..... B61B 7/06 104/96
2013/0098260 A1 * 4/2013 Creissels ..... B61B 7/02 104/87
2015/0303663 A1 * 10/2015 Wall ..... B61B 7/06 182/36
2016/0016593 A1 * 1/2016 Luger ..... B61B 3/02 104/87
2016/0039431 A1 * 2/2016 Olson ..... B61B 3/02 105/26.05
2016/0280238 A1 * 9/2016 Zamorano Morf N ... B61B 1/00

FOREIGN PATENT DOCUMENTS

WO 2010012819 A1 2/2010
WO 2011077233 A1 6/2011

* cited by examiner

SYSTEM FOR TRANSPORTING PEOPLE

BACKGROUND OF THE INVENTION

Field of the Invention

The specific invention relates to a system for transporting people or goods having at least one transport cable to which a cable car vehicle which is constructed with a travel mechanism and a vehicle cabin can be coupled or having at least one carrier cable or at least one travel path on which at least one cable car vehicle which is constructed with a travel mechanism and a vehicle cabin can be moved by means of a traction cable to which the travel mechanism is coupled.

Cable car systems are known for transporting people. These are systems in which cable car vehicles, for example, gondolas, are moved along at least one carrier cable, wherein they are moved by means of a traction cable or in which the cable car vehicles are secured to a transport cable or can be coupled to a transport cable.

These are also systems having cable car vehicles which are moved along a fixed travel path, for example, along travel rails, by means of traction cables.

In all such cable car systems, there is the difficulty that the travel paths therefore have to be at least substantially linear, since the guiding of the traction cables around curves involves significant technical difficulties.

Cable car systems in which the cable car vehicles are moved along carrier cables or by means of transport cables are therefore advantageous since the carrier cables or the transport cables are guided by means of supports, whereby transport of people is enabled in a simple manner, even under difficult topographical conditions.

Systems for transporting people using cable car vehicles which are provided with a drive motor by means of which they can be moved along travel paths, in particular along travel rails, are therefore advantageous since the travel paths may be constructed with curves without technical difficulties being caused thereby during the movement of the cable car vehicles.

BRIEF SUMMARY OF THE INVENTION

An object of the specific invention is to provide a system for transporting people by means of which, on the one hand, the advantages of the known systems for transporting people are ensured and, on the other hand, the disadvantages thereof are avoided.

This is achieved according to the invention in that the at least one transport cable or the at least one carrier cable or the travel path is adjoined by at least one additional travel path, in particular at least one travel rail, along which at least one carrier vehicle which is constructed with a drive motor for the cable car vehicle can be moved, wherein the travel mechanism of the cable car vehicle can be advanced toward the carrier vehicle and can be secured thereto, whereby the cable car vehicle can be moved by means of the carrier vehicle along the at least one adjacent travel path.

Preferably, the at least one adjacent travel path for the carrier vehicle is formed by at least one travel rail or at least one travel beam.

Furthermore, the carrier vehicle can be constructed with at least two pairs of running rollers and where applicable with pairs of guiding rollers.

Preferably, the carrier vehicle is constructed with a carrier frame for the travel mechanism of the cable car vehicle, to which carrier frame the travel mechanism of the cable car vehicle can be locked. To this end, the carrier vehicle and the cable car vehicle can be constructed with at least one locking device for securing the travel mechanism of the cable car vehicle to the carrier vehicle.

Preferably, the locking device has two clamping jaws. In this instance, a fixed and a movable clamping jaw may be provided, wherein the movable clamping jaw can be moved by means of a clamping lever counter to the action of a restoring force, preferably of a pressure spring, from the closed position into the open position. In this instance, the clamping lever can be constructed with a control roller with which a control rail is associated in the transfer station. Furthermore, the travel mechanism of the cable car vehicle may be constructed with at least one locking pin which cooperates with the clamping jaws located on the carrier vehicle.

The carrier vehicle may be constructed with a combustion engine or with an electric motor, wherein the electric motor is supplied with electrical power by means of conductor rails which are arranged along the travel paths. In addition, the carrier vehicle may be able to be driven in an inductive manner.

BRIEF DESCRIPTION OF THE SEVERAL VIEWS OF THE DRAWING

A system according to the invention for transporting people is explained in greater detail below with reference to an embodiment illustrated in the drawings, in which.

DESCRIPTION OF THE INVENTION

Figure 1:
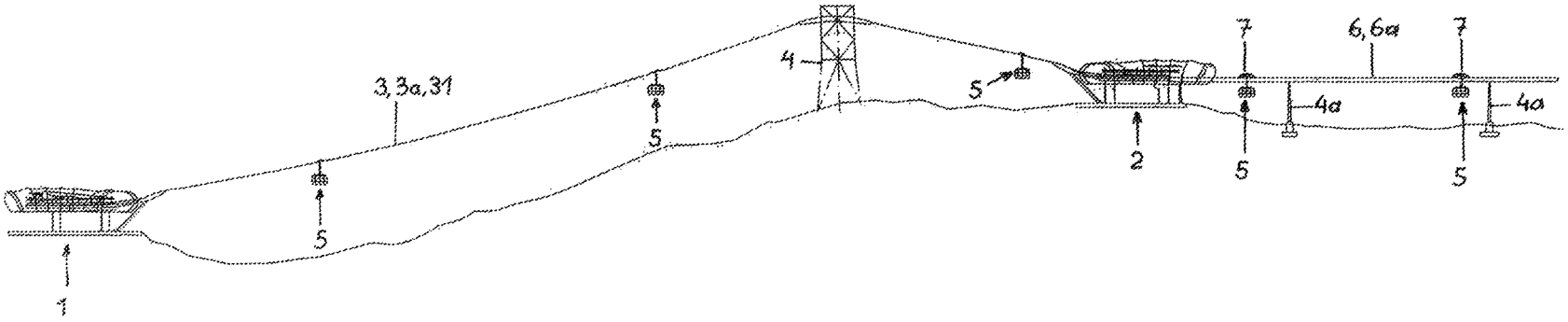
FIG. 1, FIG. 1A are a side view and a plan view of a portion of a system according to the invention for transporting people with cable car vehicles, respectively.
Figure 1A:
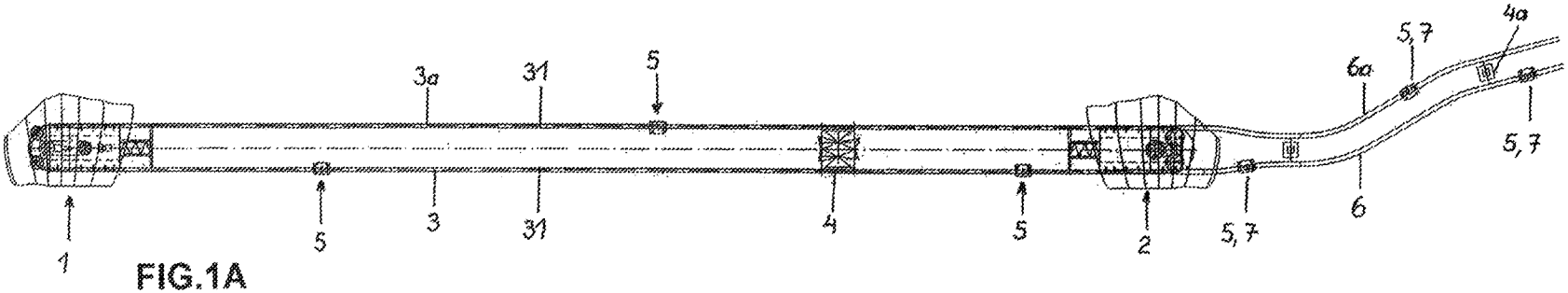

As can be seen from FIG. 1 and FIG. 1A, the illustrated portion of such a system for transporting people has an end station 1 and a transfer station 2. Between the end station 1 and the transfer station 2 are two pairs of carrier cables 3, 3*a* which are carried by at least one support 4. Cable car vehicles 5 which are coupled to traction cables 31 and which are constructed with cable car cabins can be moved along the carrier cables 3, 3*a*.

At the transfer station 2, the carrier cables 3, 3*a* are adjoined by travel paths 6, 6*a* which are located on supports 4*a* and along which carrier vehicles 7 which are constructed with drive motors for the cable car vehicles 5 can be moved. Since the carrier vehicles 7 are not moved by means of traction cables, but instead by means of the drive motors which are located thereon, the travel paths 6, 6*a* do not need to extend in a linear manner. Instead, the travel paths 6, 6*a* may be constructed with curves.

The travel paths 6, 6*a* may extend either as far as an additional transfer station, which pairs of carrier cables 3, 3*a* adjoin again, or as far as a second end station. In this instance, any number of such portions of pairs of carrier cables 3, 3*a* and travel paths 6, 6*a* may be provided. The carrier cables 3, 3*a* are provided in those portions in which the travel paths extend in a linear manner. However, as soon as bends are required, in particular as a result of the topographical conditions in the route guiding, portions having curved travel paths 6, 6*a* are provided.

The operation of such a system for transporting people is as follows:

In the end station 1, the cabins of the cable car vehicles 5 located therein are entered or left by passengers. Subsequently, the cable car vehicles 5 are moved by means of the traction cable 31 along the carrier cables 3 to the transfer station 2. In the transfer station 2, the cable car vehicles 5 are transferred onto a carrier vehicle 7 at that location. Subsequently, this carrier vehicle 7 with the cable car vehicle 5 which is secured thereto is moved along the travel path 6 either to another transfer station or to a second end station. From the second end station, the cable car vehicles 5 are moved back along the travel path 6*a* and the carrier cables 3*a* to the first end station 1.

Figure 2:
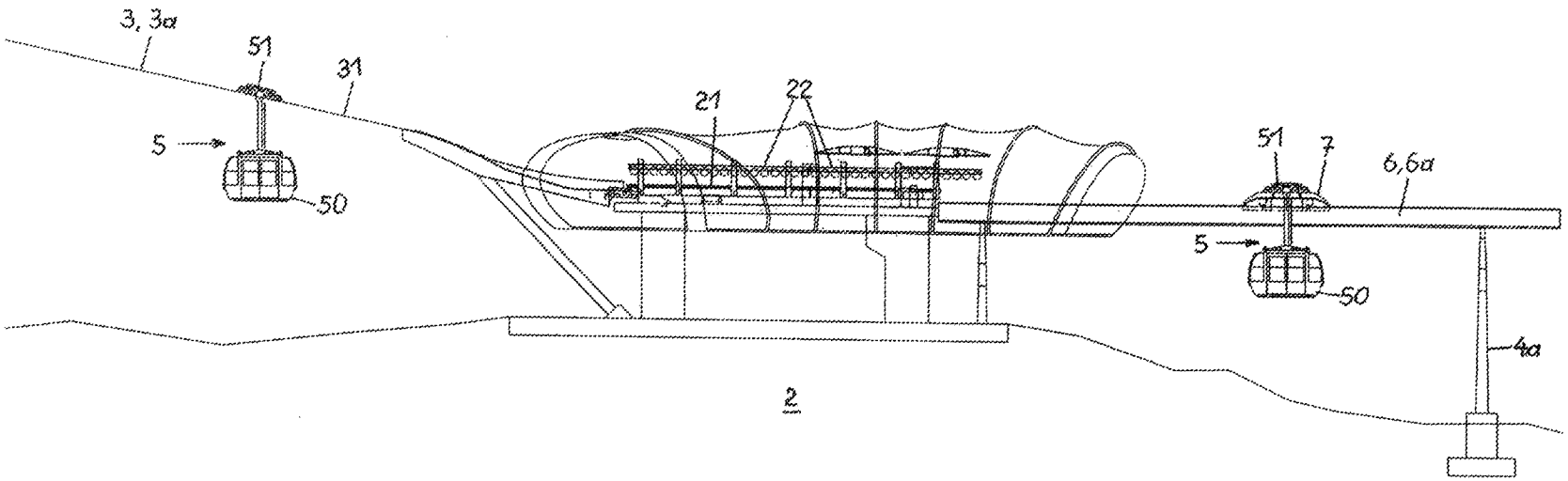
FIG. 2, FIG. 2A are a side view and a plan view of a transfer station which is located in such a system in a state drawn to an enlarged scale with respect to FIG. 1 or FIG. 1A, respectively.
Figure 2A:
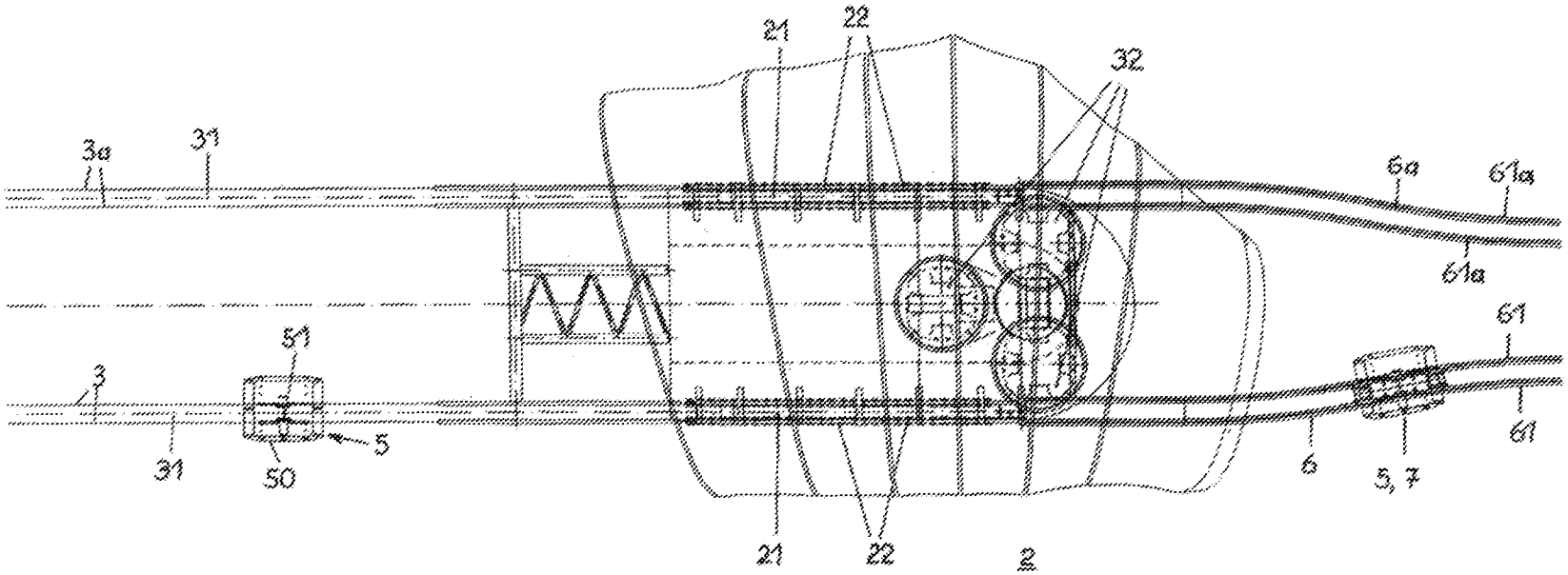

As can be seen from FIG. 2 and FIG. 2A, guiding rails 21 which are associated with the respective pairs of the carrier cables 3, 3*a* and transport tires 22 which are associated therewith are located in the transfer station 2. The cable car vehicles 5 are constructed with cable car cabins 50 and travel mechanisms 51. By means of the transport tires 22, the travel mechanisms 51 of the cable car vehicles 5, after they have been uncoupled from the traction cable 31, are moved further along the guiding rails 21. The traction cable 31 is laid over three redirection discs 32 by means of which it is guided back parallel with the second carrier cable 3*a* of the pair of carrier cables 3, 3*a* to the first end station 1. The pairs of carrier cables 3, 3*a* are adjoined by the travel paths 6, 6*a* which are each formed by pairs of travel rails 61, 61 a, along which the carrier vehicles 7 and the cable car vehicles 5 which are carried thereby can be moved.

Figure 3:
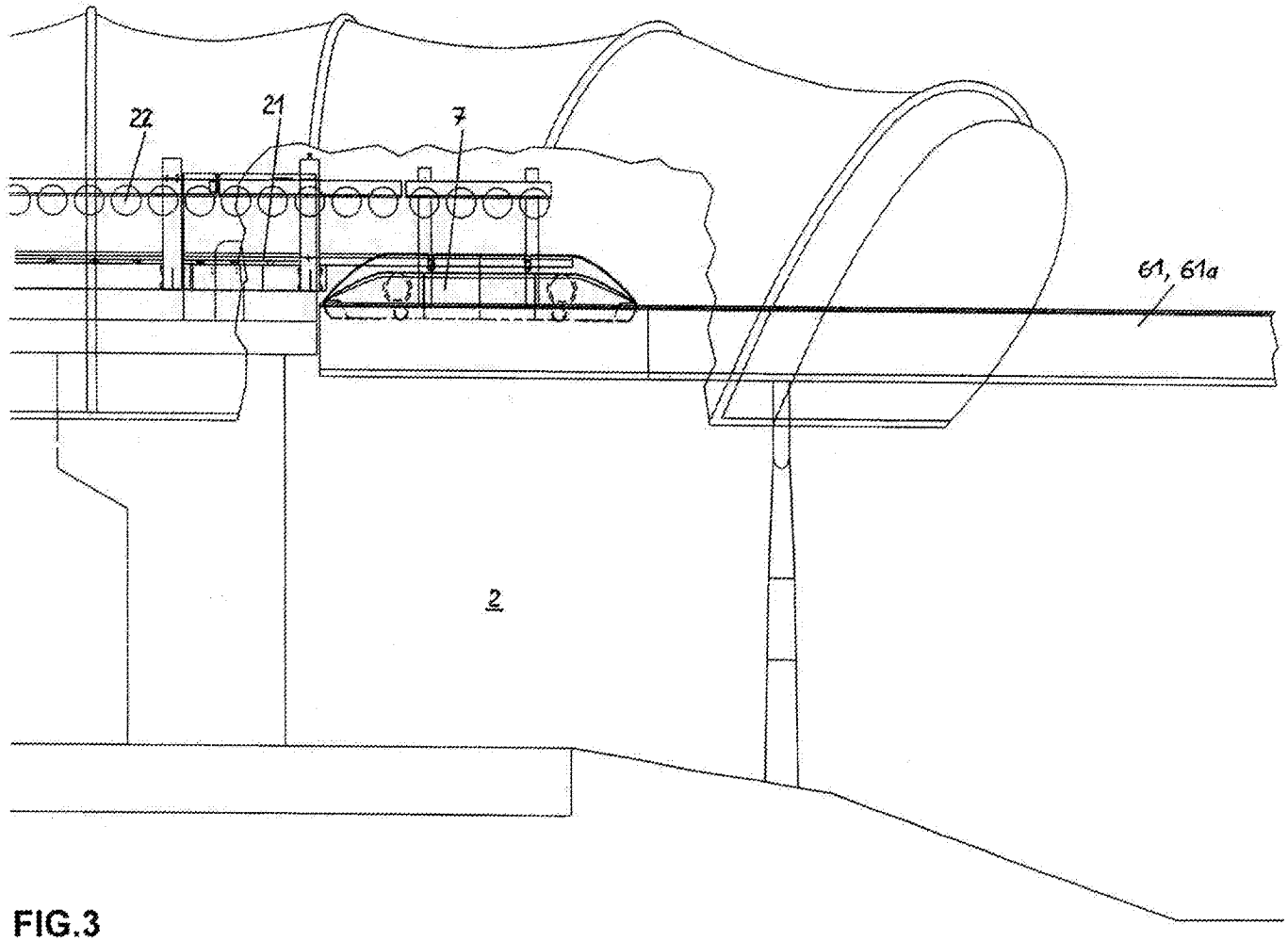
FIG. 3, shows the transfer station according to FIG. 2, drawn to an enlarged scale in comparison therewith.

FIG. 3 shows a transfer station 2 in which a carrier vehicle 7 is located.

Figure 3A:
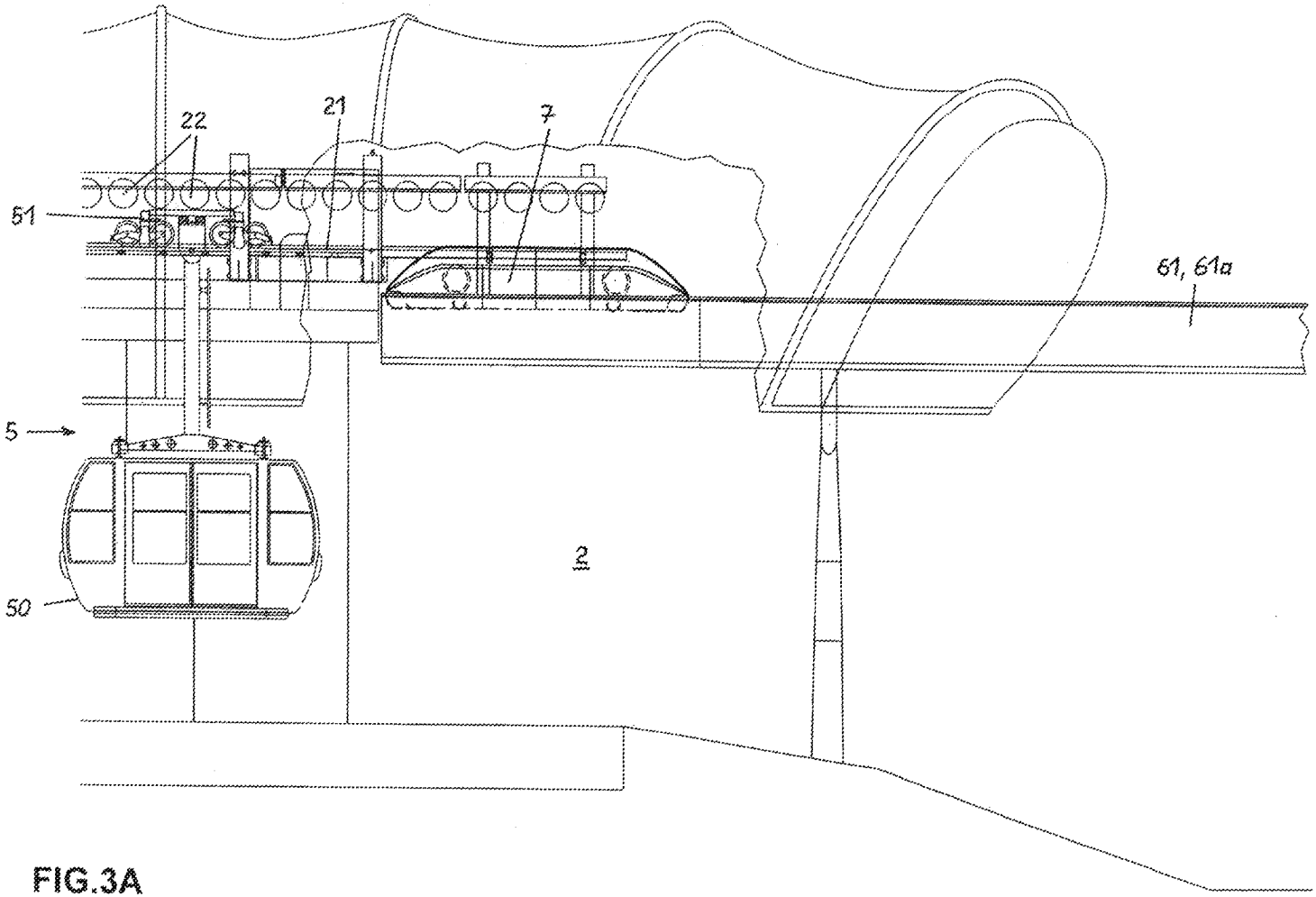
FIG. 3A shows the transfer station according to FIG. 3 in which a cable car vehicle and a carrier vehicle are located.

FIG. 3A shows the transfer station 2, in which a cable car vehicle 5 having a cabin 50 is located, after it has been uncoupled from the traction cable 31, wherein the travel mechanism 51 thereof is moved along one of the guiding rails 21 by means of the transport tires 22 to the carrier vehicle 7.

Figure 3B:
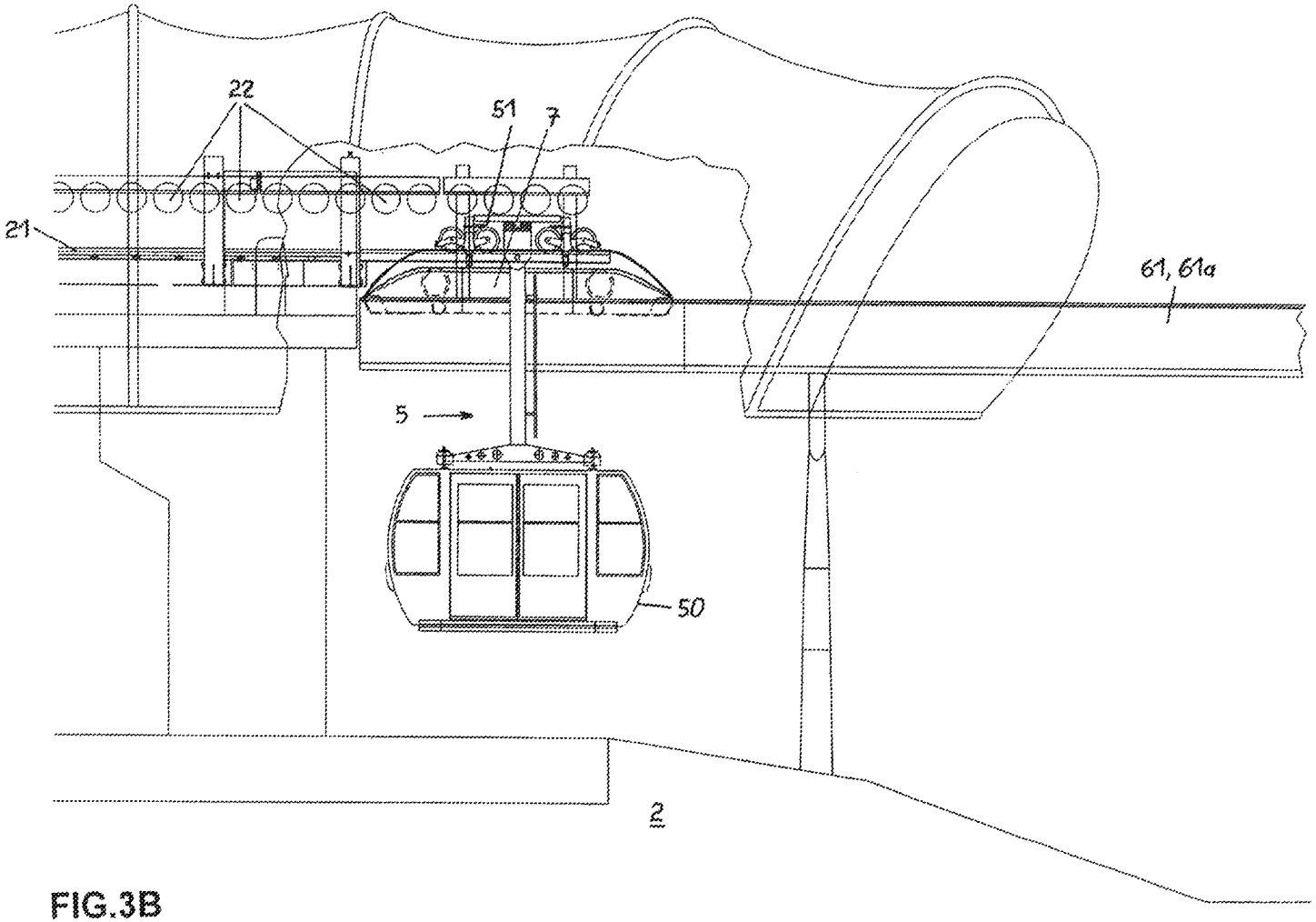
FIG. 3B shows the transfer station according to FIG. 3A, wherein the travel mechanism of the cable car vehicle is located on a carrier vehicle.

FIG. 3B shows the transfer station 2, wherein the cable car vehicle 5 is located in the position after the travel mechanism 51 thereof has been approached toward the carrier vehicle 7, wherein it is locked thereto.

Figure 3C:
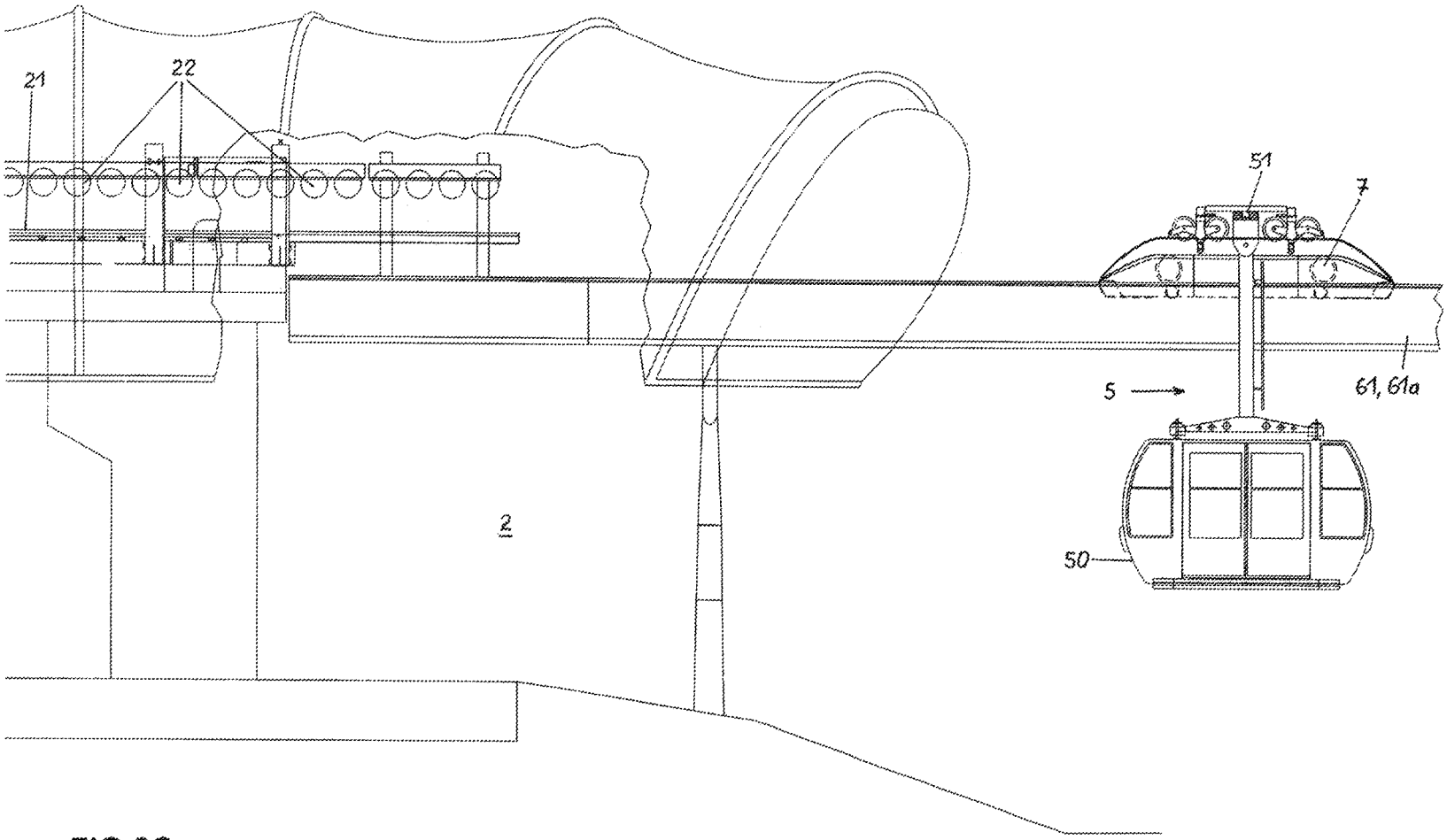
FIG. 3C shows the transfer station according to FIG. 3B, wherein the carrier vehicle with the cable car vehicle has been moved away from the transfer station.

Subsequently, the drive of the carrier vehicle 7 is switched on, whereby it is moved with the cable car vehicle 5 along the travel rails 61, as illustrated in FIG. 3C.

Figure 4A:
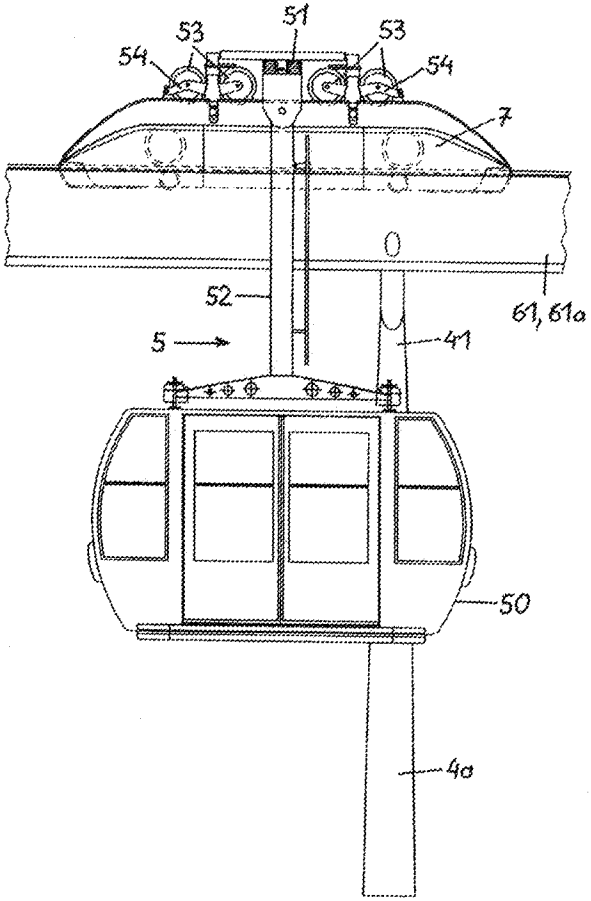
FIG. 4A is a side view of one of the travel paths on which a cable car vehicle can be moved by means of a carrier vehicle.
Figure 4:
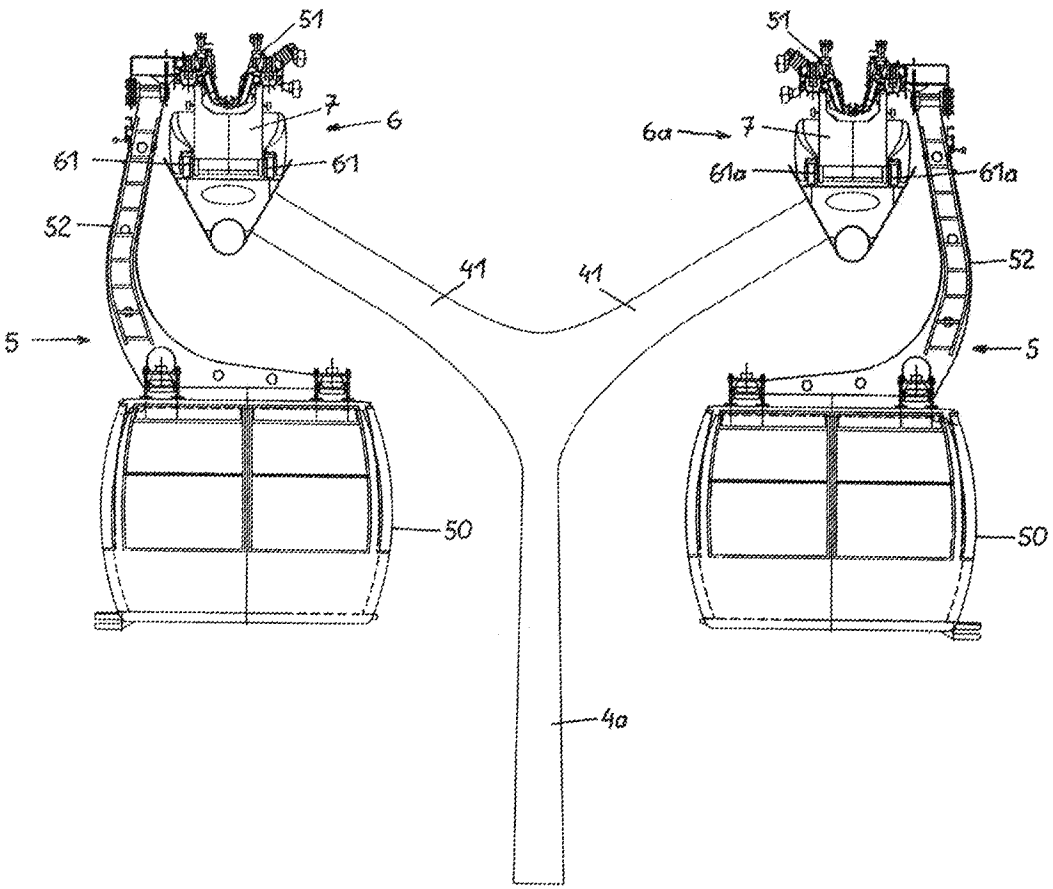
FIG. 4 is a front view of two travel paths on which a cable car vehicle can be moved in each case by means of carrier vehicles.

In FIG. 4 and FIG. 4A, a portion of this cable car system which is constructed with travel paths 6, 6*a* is illustrated as a front view.

The travel paths 6*a*, 6*a* are located on carrier beams 41 of supports 4*a*.

Each of the travel paths 6, 6*a* has a pair of travel rails 61, 61*a* along which the carrier vehicles 7 can be moved. The travel mechanism 51 of a cable car vehicle 5 is located on the carrier vehicles 7. There is articulated to the travel mechanism 51 a carrier bar 52 to which the cabin 50 is secured. The travel mechanisms 51 are constructed with four pairs of running wheels 53 which are supported on rockers 54.

Figure 5:
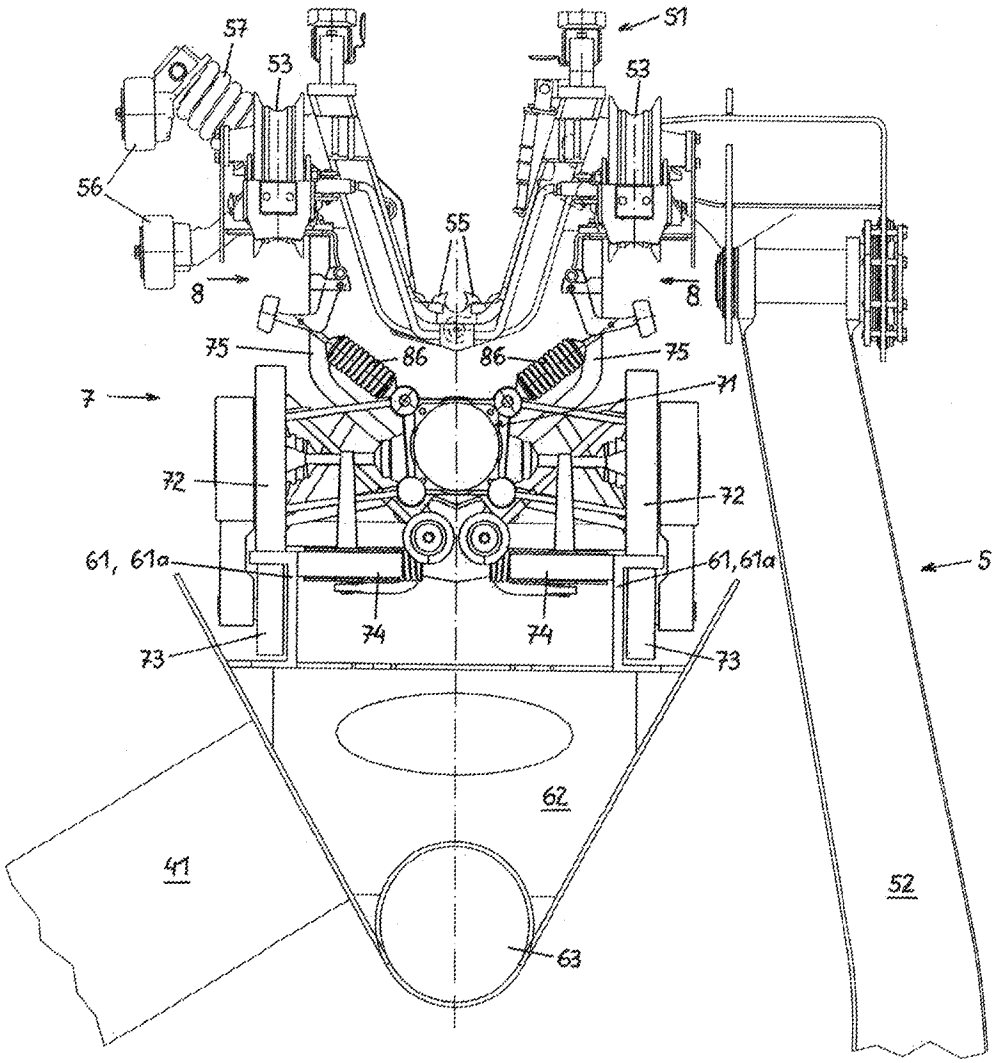
FIG. 5 is a front view of the travel mechanism of a cable car vehicle, which is located on a carrier vehicle, drawn to an enlarged scale compared with FIG. 4 and FIG. 4A.
Figure 5A:
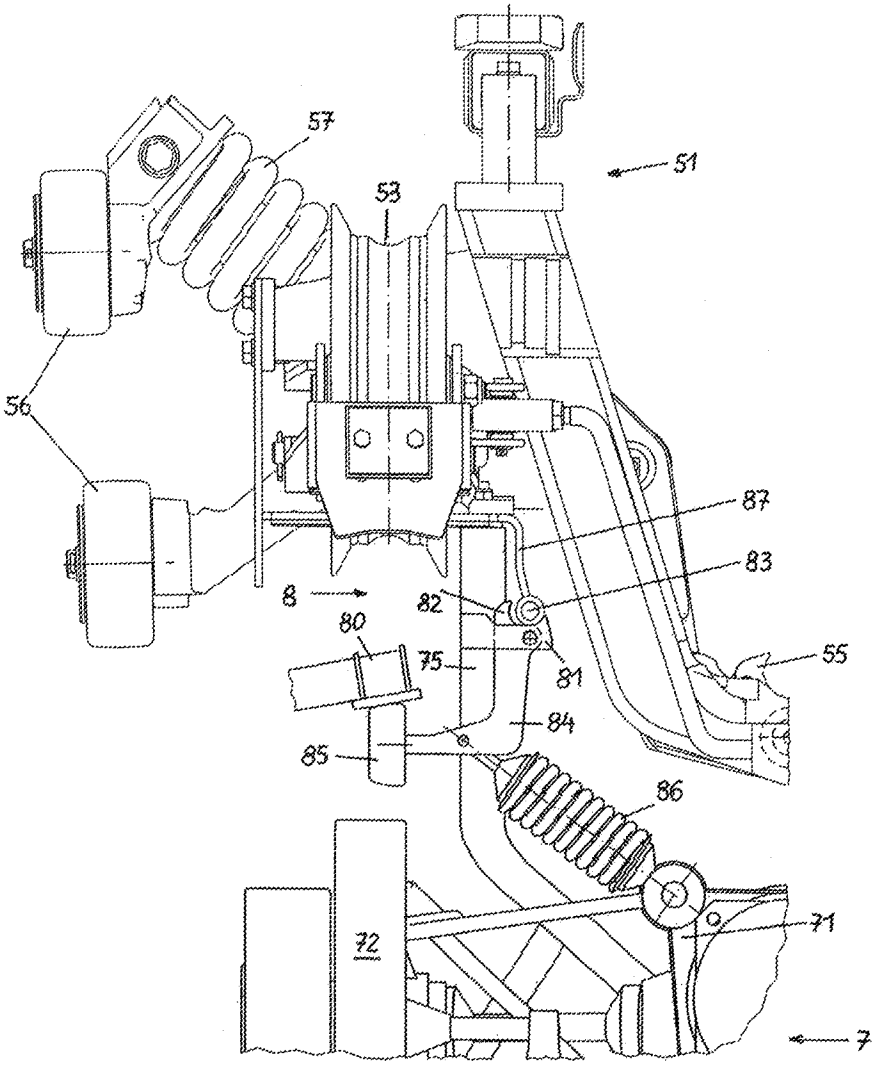
FIG. 5A shows a detail of FIG. 5, drawn to an enlarged scale in comparison therewith.

With reference to FIG. 5 and FIG. 5*a*, the travel mechanism 51 of the cable car vehicle 5 and the carrier vehicle 7 and the locking of the travel mechanism 51 to the carrier vehicle 7 are explained below.

There is articulated to the travel mechanism 51 the carrier bar 52, to the lower end of which the cabin 50—which is not illustrated in this drawing—is secured. The travel mechanism 51 is constructed with four pairs of running wheels 53, by means of which the cable car vehicle 5 can be moved along the carrier cables 3, 3*a*. The travel mechanism 51 is further constructed with clamping jaws 55 by means of which the travel mechanism 51 can be clamped to the traction cable 31 which is associated with the two pairs of carrier cables 3, 3*a*. The two clamping jaws 55 are moved into their closed position by means of control rollers 56 which are under the action of pressure springs 57, whereby the travel mechanism 51 can be coupled to the traction cable 31.

The travel rails 61, 61*a* are secured by means of carrier sheets 62 which are spaced apart from each other to carrier pipes 63 which extend along the travel paths 6, 6*a*. The carrier pipes 63 are secured to the carrier beam 41. Each carrier vehicle 7 is constructed with a travel frame 71 on which there are supported a plurality of pairs of running rollers 72, guiding rollers 73 which can be rotated about axes which are orientated at least substantially horizontally, and guiding rollers 74 which can be rotated about axes which are orientated at least vertically.

The running rollers 72 travel on the upper side of the travel rails 61, 61*a*. The guiding rollers 73 and 74 travel on horizontal and vertical abutment faces of the travel rails 61, 61*a*, whereby the carrier vehicle 7 is guided along the travel paths 6, 6*a*. Each carrier vehicle 7 is constructed with a carrier frame 75, on which the travel mechanism 51 of the cable car vehicle 5 is brought for support. The travel mechanism 51 is secured to the carrier vehicle 7 by means of two locking devices 8.

As can be seen in particular in FIG. 5A, the locking devices 8 comprise a fixed clamping jaw 81 and a movable clamping jaw 82 which are located on the carrier frame 75, and a locking pin 83 which is secured to the travel frame 51 by means of a carrier sheet 87. The movable clamping jaw 82 is located on a clamping lever 84 which can be moved by means of a control roller 85 which is guided along a control rail 80 counter to the action of a pressure spring 86 into the open position thereof and is retained therein.

As soon as the travel mechanism 51 on the carrier vehicle 7 has been moved into position so that the locking pin 83 is located between the two clamping jaws 81 and 82 which are located in the open position thereof, the movable clamping jaw 81, as soon as the control roller 85 has left the control rail 80, is moved by the pressure spring 86 into the closed position thereof, whereby the travel mechanism 51 is locked to the carrier vehicle 7.

When a cable car vehicle 5 is moved into a transfer station 2, the cable car vehicle 5 is uncoupled from the traction cable 31 and the travel mechanism 51 thereof is moved along the guiding rails 21 by means of the transport tires 22 to a carrier vehicle 7 which is located in the transfer station 2 and placed thereon. Subsequently, the cable car vehicle 5 is secured by means of the two locking devices 8 to the carrier vehicle 7. Subsequently, the cable car vehicle 5 is moved by means of the carrier vehicle 7 along the pair of travel rails 61 to a second end station or to another transfer station. In the other transfer station, the cable car vehicle 5 is unlocked from the carrier vehicle 7, further moved by means of the transport tires 22 along the guiding rails 21 to another pair of carrier cables 3, coupled at that location to another traction cable 31 and moved along the carrier cables 3 to another station.

Along the travel rails 61 a and the carrier cables 3*a*, the carrier vehicles 7 and the cable car vehicles 5 are moved back to the transfer station 2 and to the end station 1.

The drive of the carrier vehicles 7 is carried out by means of combustion engines or by means of electric motors. To this end, there may be provided along the travel paths 6, 6*a* conductor rails by means of which the electric motors are supplied with electrical power. In addition, an inductive drive of the carrier vehicles 7 may be provided.

By means of such a combination of a system for transporting people formed by carrier cables 3, 3*a* and travel paths 6, 6*a*, the travel paths may therefore be adapted to the specific topographical conditions since the travel paths 6, 6*a* do not have to extend in a linear manner, but instead can be constructed with curved regions.

The invention claimed is:

1. A transport system, comprising:

a multi-segment travel path including a cableway segment and at least one additional travel path adjoining said cableway segment;

said cableway segment having at least one transport cable or at least one carrier cable and an associated traction cable;

said at least one additional travel path for said carrier vehicle being a track segment formed with at least one travel rail or at least one travel beam;

at least one cable car vehicle for transporting people or goods, said at least one cable car vehicle having a vehicle cabin and a travel mechanism for coupling to said at least one transport cable or to said traction cable; and at least one carrier vehicle equipped with a drive motor for moving said at least one carrier vehicle along said additional travel path;

wherein said travel mechanism of said cable car vehicle can be advanced toward said carrier vehicle and secured thereto, whereupon said carrier vehicle moves said cable car vehicle along said additional travel path in continuance of the multi-segment travel path.

2. The system according to claim 1, wherein said carrier vehicle comprises at least two pairs of running rollers.

3. The system according to claim 2, wherein said carrier vehicle further comprises pairs of guiding rollers.

4. The system according to claim 1, wherein said carrier vehicle comprises a carrier frame for said travel mechanism of said cable car vehicle, and said travel mechanism of said cable car vehicle is configured to be locked to said carrier frame.

5. The system according to claim 4, wherein said carrier vehicle and said cable car vehicle include at least one locking device for securing said travel mechanism of said cable car vehicle to said carrier vehicle.

6. The system according to claim 5, wherein said locking device has two clamping jaws.

7. The system according to claim 5, wherein said locking device has a fixed clamping jaw and a movable clamping jaw, said movable clamping jaw is movable by way of a clamping lever counter to a restoring force, from the closed position into the open position.

8. The system according to claim 7, wherein the restoring force is generated by a pressure spring.

9. The system according to claim 7, wherein said clamping lever is formed with a control roller disposed to interact with a control rail in a transfer station between said cableway segment and said additional travel path.

10. The system according to claim 4, wherein said travel mechanism of said cable car vehicle is formed with at least one locking pin configured to cooperate with clamping jaws located on said carrier vehicle.

11. The system according to claim 1, wherein said drive motor of said carrier vehicle is a combustion engine.

12. The system according to claim 1, wherein said drive motor of said carrier vehicle is an electric motor.

13. The system according to claim 12, which further comprises conductor rails arranged along said additional travel path and configured to supply said electric motor with electrical power.

14. The system according to claim 1, wherein said carrier vehicle is drivable in an inductive manner.

15. A transport system, comprising:

a multi-segment travel path including a cableway segment and at least one additional travel path adjoining said cableway segment;

said cableway segment having at least one transport cable or at least one carrier cable and an associated traction cable;

at least one cable car vehicle for transporting people or goods, said at least one cable car vehicle having a vehicle cabin and a travel mechanism for coupling to said at least one transport cable or to said traction cable; and at least one carrier vehicle equipped with a drive motor for moving said at least one carrier vehicle along said additional travel path;

wherein said travel mechanism of said cable car vehicle can be advanced toward said carrier vehicle and secured thereto, whereupon said carrier vehicle moves said cable car vehicle along said additional travel path in continuance of the multi-segment travel path;

said carrier vehicle having a carrier frame for said travel mechanism of said cable car vehicle, and said travel mechanism of said cable car vehicle being configured to be locked to said carrier frame; and said carrier vehicle and said cable car vehicle including at least one locking device for securing said travel mechanism of said cable car vehicle to said carrier vehicle.

16. A transport system, comprising:

a multi-segment travel path including a cableway segment and at least one additional travel path adjoining said cableway segment;

said cableway segment having at least one transport cable or at least one carrier cable and an associated traction cable;

at least one cable car vehicle for transporting people or goods, said at least one cable car vehicle having a vehicle cabin and a travel mechanism for coupling to said at least one transport cable or to said traction cable;

at least one carrier vehicle equipped with an electric drive motor for moving said at least one carrier vehicle along said additional travel path; and conductor rails arranged along said additional travel path and configured to supply said electric drive motor with electrical power;

wherein said travel mechanism of said cable car vehicle can be advanced toward said carrier vehicle and secured thereto, whereupon said carrier vehicle moves said cable car vehicle along said additional travel path in continuance of the multi-segment travel path.

* * * * *